US005876094A

United States Patent [19]

Hoffman

[11] Patent Number: 5,876,094

[45] Date of Patent: Mar. 2, 1999

[54] ADJUSTABLE MECHANISM FOR ROCKER-RECLINER

[75] Inventor: D. Stephen Hoffman, High Point, N.C.

[73] Assignee: Ultramek, Inc., Denton, N.C.

[21] Appl. No.: 932,668

[22] Filed: Sep. 18, 1997

[51] Int. Cl.[6] ..... A47C 3/027

[52] U.S. Cl. ..... 297/259.2; 297/259.4; 297/267.1; 297/DIG. 7

[58] Field of Search ..... 297/DIG. 7, 267.1, 297/259.2, 259.4, 264.1, 265.1

[56] References Cited

U.S. PATENT DOCUMENTS

| | | | |
|---|---|---|---|
| 3,996,251 | 12/1976 | Belisle | 297/267.1 |
| 4,140,342 | 2/1979 | Jones | 297/267.1 |
| 4,707,025 | 11/1987 | Rogers, Jr. | 297/DIG. 7 |
| 5,171,000 | 12/1992 | LaPointe et al. | 297/267.1 |
| 5,370,442 | 12/1994 | Saul et al. | 297/267.1 |
| 5,435,622 | 7/1995 | Fay et al. | 297/DIG. 7 |
| 5,564,781 | 10/1996 | Pine | 297/DIG. 7 |

*Primary Examiner*—Milton Nelson, Jr.
*Assistant Examiner*—Anthony D. Barfield
*Attorney, Agent, or Firm*—Myers Bigel Sibley & Sajovec

[57] ABSTRACT

A rocking and reclining chair comprises: a base having a pair of generally horizontal planar bearing surfaces; a generally horizontally-disposed seat positioned above the base; a generally upright backrest positioned above the base rearward of the seat; a reclining assembly for moving the seat and backrest between upright and reclined positions relative to the base; a pair of rocker cams; and a pair of rocker spring assemblies. The reclining assembly is attached to the seat and the backrest and includes a pair of mechanisms and front and rear stabilizing members. Each reclining mechanism includes a plurality of pivotally interconnected links, two of which are a seat mounting plate attached to the seat and a cam mounting plate. The cam mounting plate includes first and second sets of spring assembly mounting holes and first and second sets of rocker cam mounting holes, and further includes front and rear cross-member mounting locations (preferably inwardly-directed flanges). The front and rear stabilizing members are attached between respective cross-member mounting locations. Each of the rocker cams is attached to a respective mechanism cam mounting plate via fasteners inserted through one of each of the first and second sets of rocker cam mounting holes. Each rocker cam includes an arcuate lower contact surface positioned below a lower edge of the cam mounting plate to contact a respective one of the base bearing surfaces. The lower contact surfaces are configured for rolling contact with the base bearing surfaces such that the seat has a rocking motion. Each rocker spring assembly includes a resilient member that biases the seat against rocking motion relative to the base. Also, each rocker spring assembly is attached to a respective cam mounting plate and to the base via fasteners inserted into one of the first set of spring assembly mounting holes and one of the second set of spring assembly mounting holes.

18 Claims, 5 Drawing Sheets

ADJUSTABLE MECHANISM FOR ROCKER-RECLINER

FIELD OF THE INVENTION

This invention relates generally to seating units, and relates more particularly to reclining seating units with rocking capability.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

One particularly popular reclining chair is the so-called "rocker-recliner," which can, when in the upright position, rock with a forward and rearward motion similar to that of a traditional rocking chair. A typical rocker recliner, one of which is illustrated in U.S. Pat. No. 4,519,647 to Rogers, includes a wooden arcuate rocker cam that is attached with the lower portion of each mechanism, with the lower convex surface of the rocker cam contacting a level portion of the base (also typically formed of wood). Also, a spring assembly is mounted to the base of the chair and to each rocker cam. Each spring assembly includes two quite stiff, vertically-oriented helical springs attached to mounting brackets that are in turn fixed to the base and to the rocker cam. When the chair is in its upright position and is unoccupied, the seat, backrest and reclining mechanisms reside above the base, the rocker springs are deflected only along their longitudinal axes, and the rocker cams rest on a level portion of the base. When an occupant sits on the chair and applies a forwardly- or rearwardly-directed force to the seat or backrest, the seat and backrest move relative to the base. The path of movement is defined by the convex shape of the rocker cams as they rock on the level surface of the base, with the result that the seat and backrest simulate the rocking motion of a rocking chair. During the rocking movement, the rocker springs deflect such that their top portions bend away from their longitudinal axes as the chair rocks forward and back. The deflection in the springs urges the springs (and, in turn, the seat and backrest) to return to their original positions as the chair returns to and through the upright position. In this manner, the chair is capable of providing a controlled rocking motion when in the upright position. Most, if not all, chairs of this design include some type of safety feature, such as an extendable foot, that prevents rocking when the chair is in a reclined position.

One specific concern raised by the typical rocker-recliner mechanism is the production of the rocker cams. Clearly, the rocking motion of the chair is controlled by the shape and condition of the arcuate surfaces of the rocker cams. Thus, incorrectly shaped rocker cams can preclude a smooth rocking motion. Also, imperfections in the rocker cam surface, such as nicks or bumps, can often be felt by the occupant during rocking. As such, production of wooden rocker cams can be quite precise and labor-intensive, which can raise their cost significantly.

Because of their rocking capabilities, rocker-recliners of the configuration described above have achieved significant popularity, and as such are in demand in many different aesthetic styles and reclining motions. For example, some chairs are constructed so that the seat and backrest are fixed relative to one another and recline as a unit, while others are designed so that the backrest can pivot relative to the seat. Some recliners move to only one reclined position, while others move to two reclined positions. Of course, these varied motions are controlled by the reclining mechanisms, each of which must be configured differently to operate as desired. In addition, the aesthetic diversity demanded by consumers can also impose significant constraints on chair designers as they attempt to design a chair that operates properly and is visually appealing.

Due to the complexity of reclining mechanisms, manufacturers of recliner chairs have attempted to limit the number of different mechanisms they produce. The same is true of rocker cams and rocker spring assemblies. As such, designers are forced to devise configurations mechanisms, rocker cams, springs and bases that represent compromises between style and operational concerns. In addition, combining a number of different mechanisms, rocker cams, springs, bases, and seat and backrest styles can also raise manufacturing concerns.

One proposed alternative to the typical rocker-recliner mechanism is a rocker unit, available from Super Sagless, Tupelo, Miss., that incorporates the rocker springs and the base as a single unit. The base is a single welded piece comprising two spaced-apart legs and two cross beams welded to and connecting the legs. Thermoplastic rocker cams rest on the upper surfaces of the base legs. Each of these is positioned beneath and mounted to an auxiliary mounting plate. The auxiliary mounting plates are welded to two additional cross members that are positioned above the base cross members. The rocker spring assemblies are mounted between the cross members of the base and the cross members attached to the auxiliary mounting plates. A rocker unit of this configuration can be assembled in one location, then shipped to another manufacturing site, where reclining mechanisms can be attached to each auxiliary mounting plate and mounted thereto during production of a chair.

Although under some circumstances there is some advantage to the use of this single unit, there are significant shortcomings. For example, replacement of a faulty rocker cam can be laborious, as the cross members welded to the auxiliary mounting plates must be disassembled from the rocker springs in order to enable the rocker cams to be removed from the auxiliary mounting plates. Also, the rocker unit is rather bulky, therefore rendering it cumbersome to ship and store. In addition, the unit does not permit the adjustment of the positions of the rocker springs relative to the rocker cams and the reclining mechanisms after assembly, so its usefulness with a wide variety of mechanisms may be limited. Further, the available space for attaching the auxiliary mounting plates to a mounting plate of an existing reclining mechanism is limited, in particular by the presence of the cross members of the auxiliary mounting plates.

SUMMARY OF THE INVENTION

In view of the foregoing, it is an object of the present invention to provide a rocker-recliner that is easily manufactured.

It is also an object of the present invention to provide a rocker unit for a rocker-recliner that is easily manufactured and that facilitates the subsequent production of a rocker-recliner.

It is an additional object of the present invention to provide a rocker unit that is easily shipped and stored.

It is a further object of the present invention to provide a such a rocker unit that in which the rocker cams can be replaced easily.

It is a still further object of the present invention to provide a rocker cam that can be inexpensively manufactured and that provides smooth rocking motion.

These objects and others are satisfied by the present invention, which relates to a rocking and reclining chair that can be easily and inexpensively manufactured. The rocking and reclining chair comprises: a base having a pair of generally horizontal planar bearing surfaces; a generally horizontally-disposed seat positioned above the base; a generally upright backrest positioned above the base rearward of the seat; a reclining assembly for moving the seat and backrest between upright and reclined positions relative to the base; a pair of rocker cams; and a pair of rocker spring assemblies. The reclining assembly is attached to the seat and the backrest and includes a pair of mechanisms and front and rear stabilizing members. Each reclining mechanism includes a plurality of pivotally interconnected links, two of which are a seat mounting plate attached to the seat and a base plate. The base plate includes first and second sets of spring assembly mounting holes and first and second sets of rocker cam mounting holes, and further includes front and rear cross-member mounting locations (preferably inwardly-directed flanges). The front stabilizing member is attached between the front cross-member mounting locations of the base plates, and the rear stabilizing cross-member is attached between the rear cross-member mounting locations of the base plates. Each of the rocker cams is attached to a respective mechanism base plate via fasteners inserted through one of the first set of rocker cam mounting holes and one of the second set of rocker cam mounting holes. Each rocker cam includes an arcuate lower contact surface positioned below a lower edge of the base plate to contact a respective one of the base bearing surfaces. The lower contact surfaces are configured for rolling contact with the base bearing surfaces such that the seat has a rocking motion. Each rocker spring assembly includes a resilient member that biases the seat against rocking motion relative to the base. Also, each rocker spring assembly is attached to a respective base plate and to the base via fasteners inserted into one of the first set of spring assembly mounting holes and one of the second set of spring assembly mounting holes. In this configuration, the rocker cams and rocker spring assemblies can be adjusted relative to the base and reclining mechanisms, thereby providing greater design flexibility.

In one embodiment, the rocker cams are formed of hollow tubes of substantially rectangular cross-section, and are preferably formed of steel. This configuration provides a strong rocker cam that has a consistently accurate contact surface and that can be less expensive to produce than prior art rocker cams.

In addition, the rocking and reclining chair of the present invention can be assembled by attaching the rocker cams to the reclining mechanisms, the rocker springs to the reclining mechanisms, the front and rear cross members to the reclining mechanisms, then attaching the rocker spring assemblies to the base. By preceding the attachment of the rocker spring assembly to the base with the attachment of the rocker cams to the reclining mechanisms, assembly can be simplified and design flexibility increased.

DETAILED DESCRIPTION OF THE PREFERRED EMBODIMENTS

The present invention will be described more particularly hereinafter with reference to the accompanying drawings. The invention is not intended to be limited to the illustrated embodiments; rather, these embodiments are intended to fully and completely disclose the invention to those skilled in this art.

This invention is directed to seating units that have a stationary base, a seat portion, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating units between their armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane.

Figure 1:
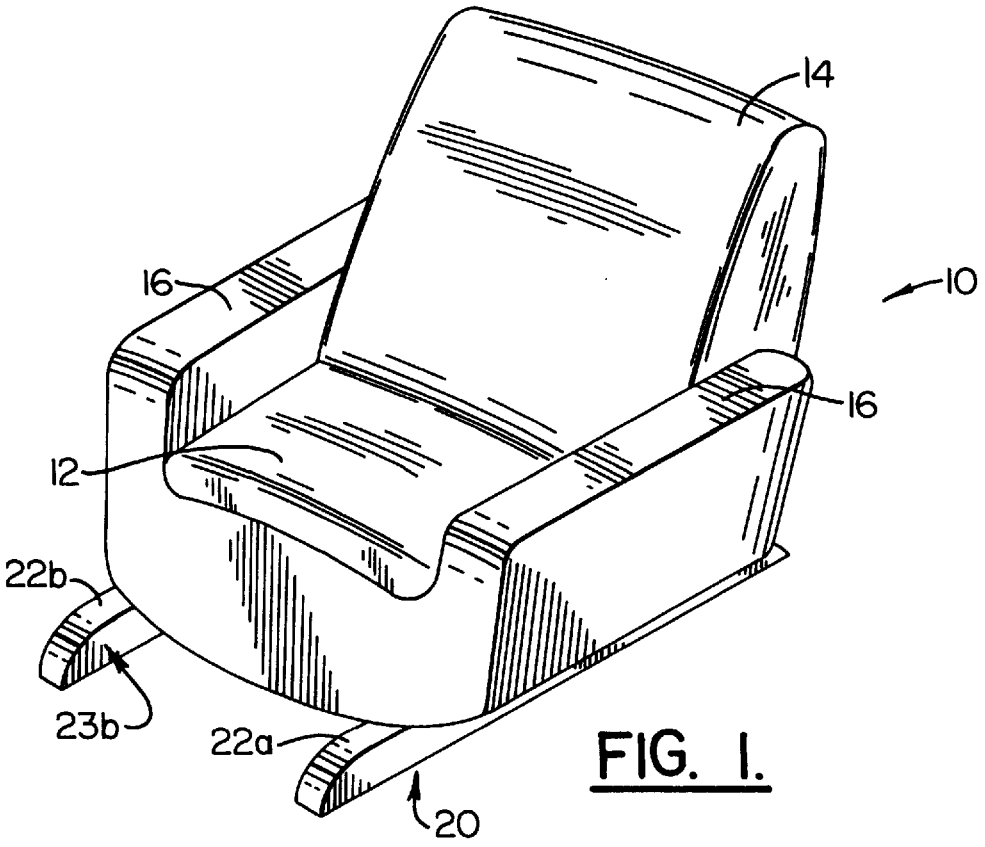
FIG. 1 is a perspective view of a rocker-recliner chair of the present invention.

Referring now to the drawings, a rocker-recliner chair, designated broadly at 10, is illustrated at FIG. 1. The chair 10 includes a generally horizontally disposed seat 12, a generally upright backrest 14, and a pair of arm rests 16 that are fixed to the seat 12. The seat 12, the backrest 14, and armrest 16 are positioned above a base 20 that is configured to rest upon an underlying surface.

Figure 5:
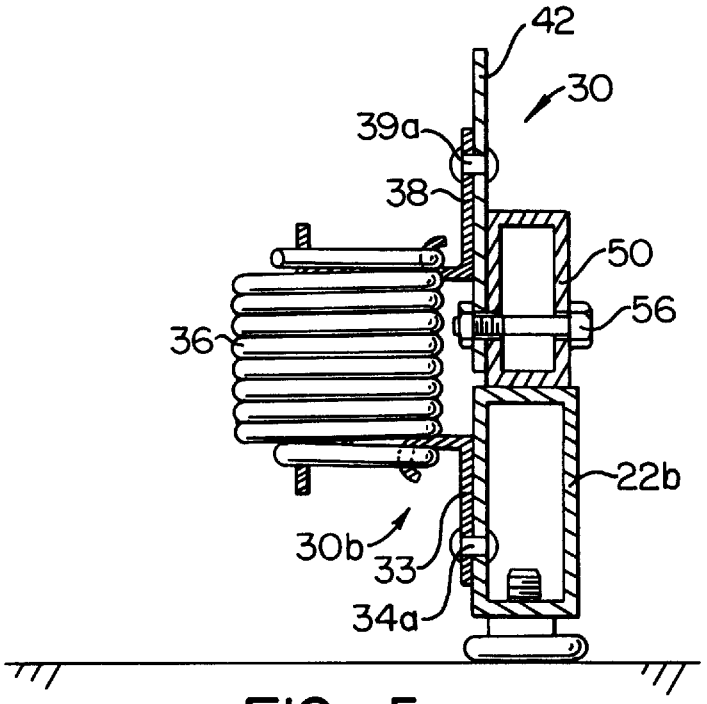
FIG. 5 is an enlarged section view taken along lines 5—5 of FIG. 4 showing a rocker spring, rocker cam and base.
Figure 3:
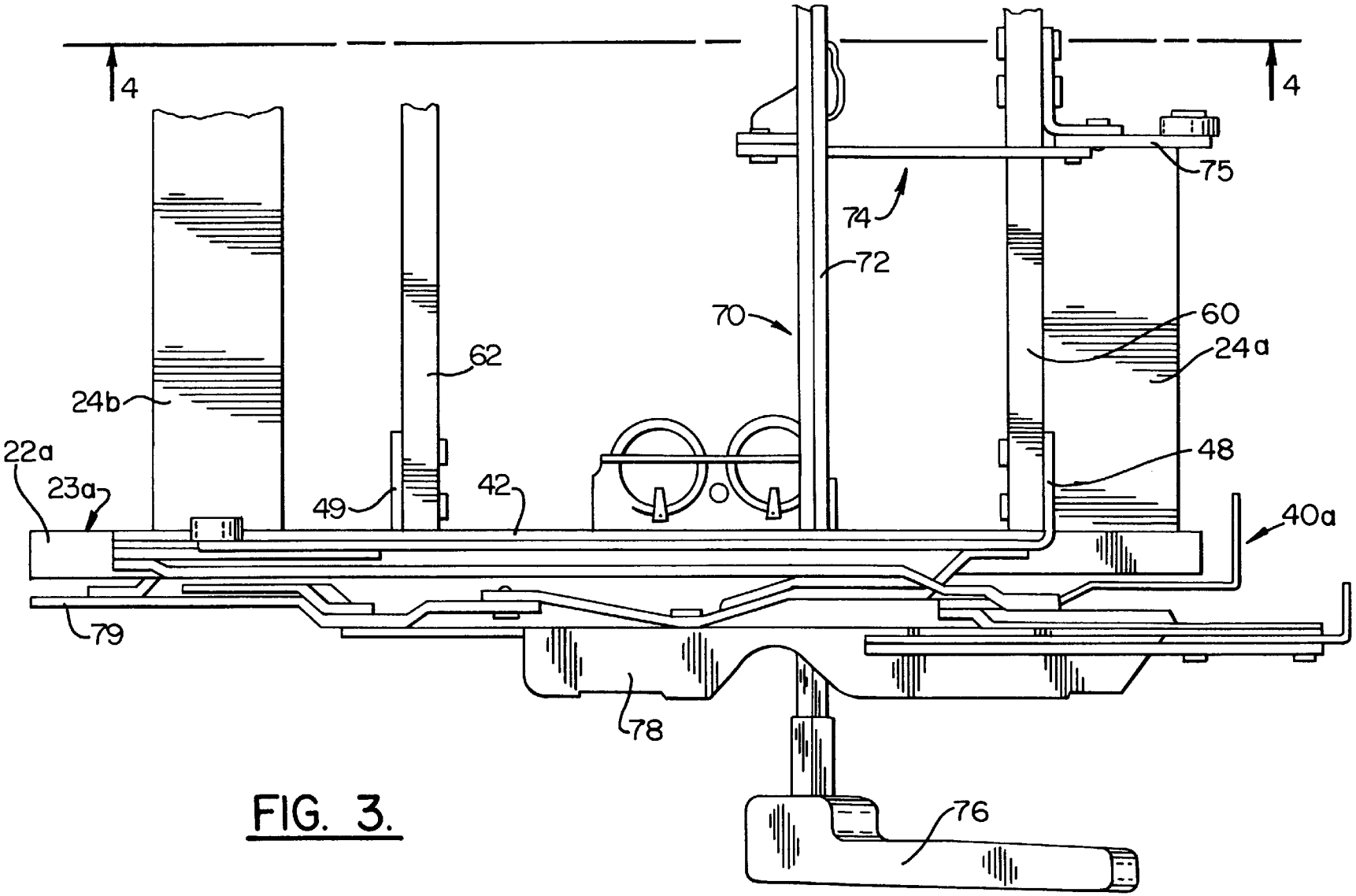
FIG. 3 is a partial top view of the rocking and reclining mechanism of FIG. 2.
Figure 4:
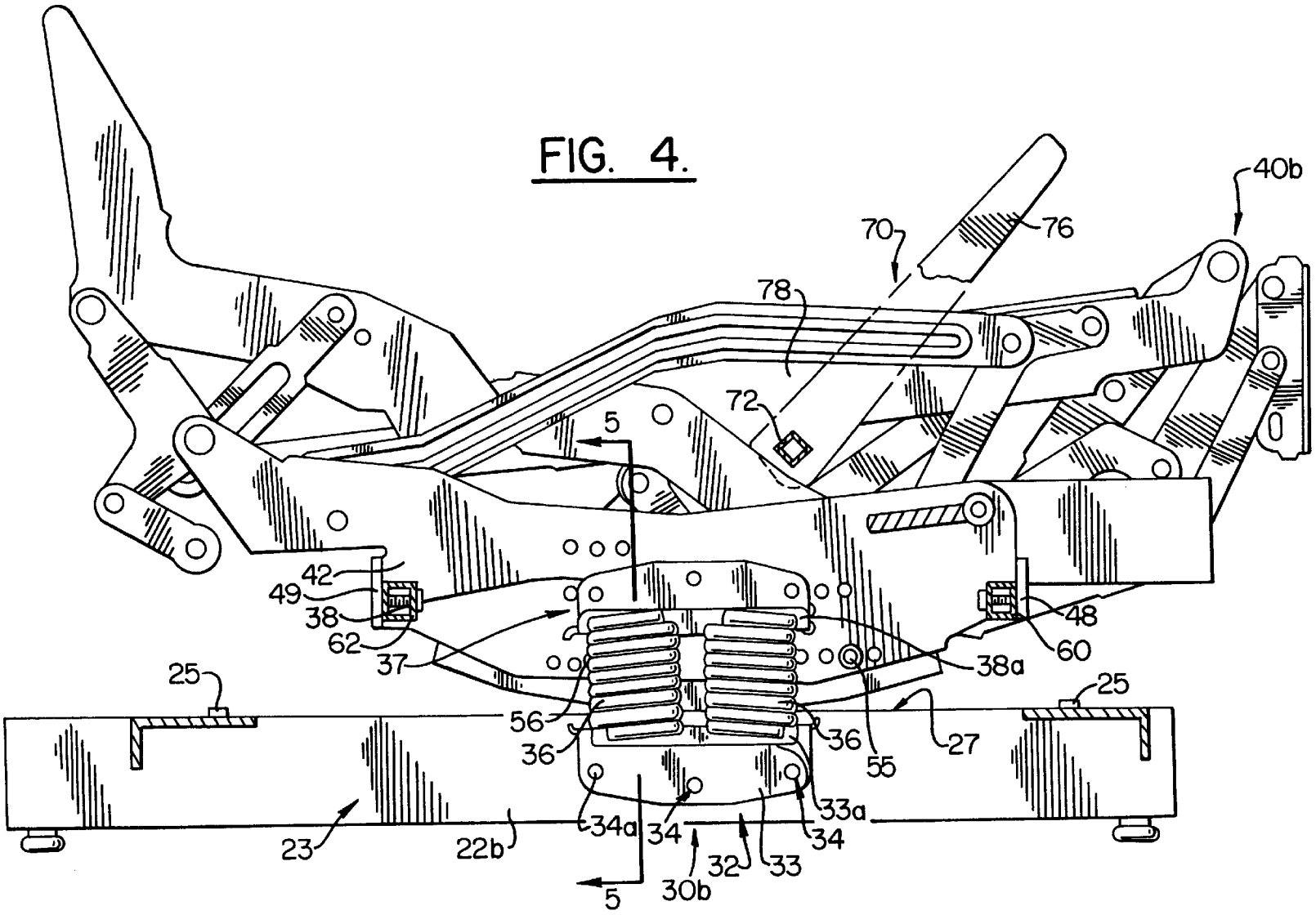
FIG. 4 is an internal side view of a rocking and reclining mechanism of the chair of FIG. 1.
Figure 6:
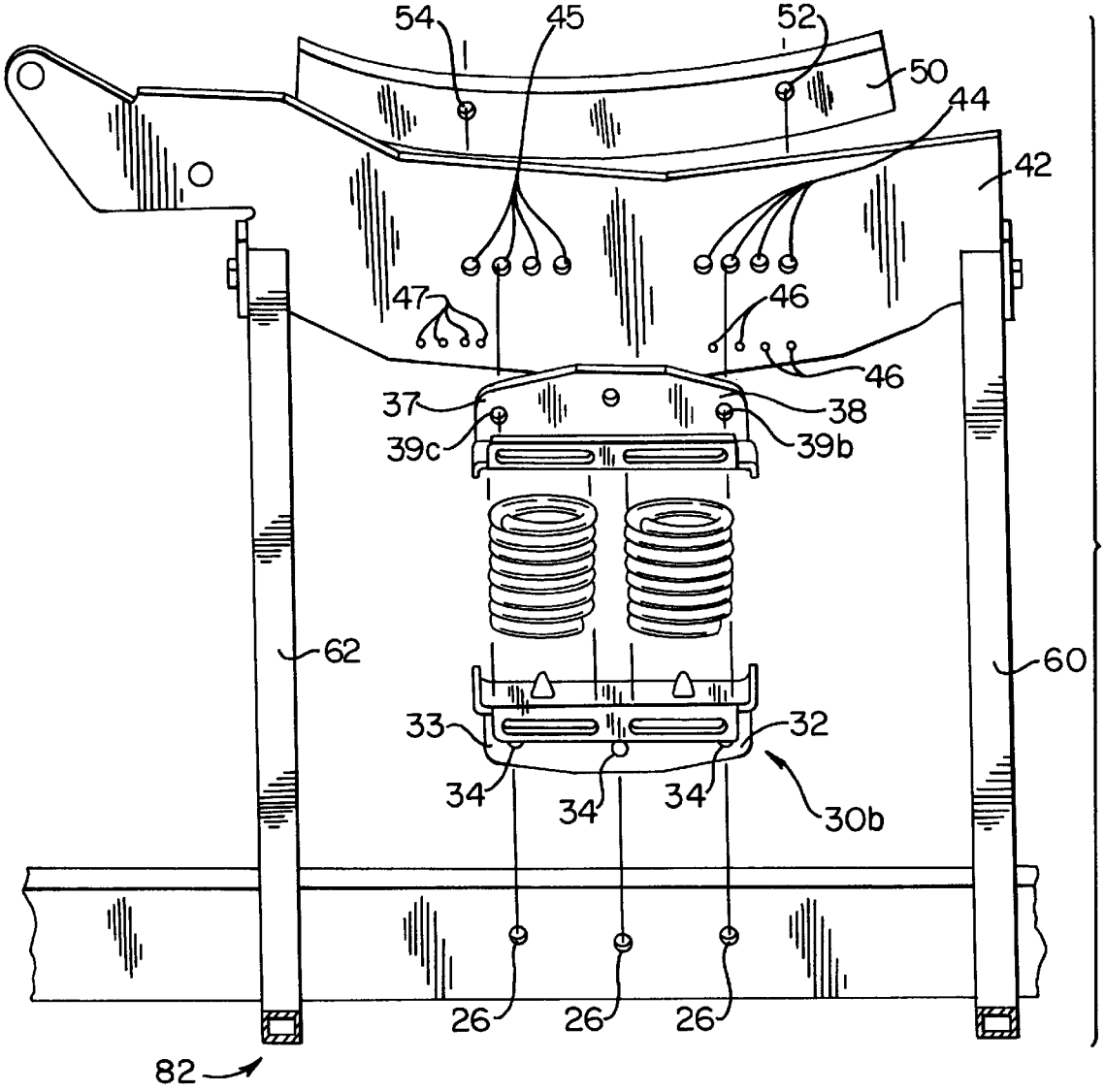
FIG. 6 is an exploded view of a reclining mechanism, a rocker spring assembly, a rocker cam, and the base.

As best seen in FIGS. 3, 4 and 5 the base 20 is formed of steel and includes a pair of base rails 22*a*, 22*b*, each of which has a respective inner surface 23*a*, 23*b*. The base rails 22*a*, 22*b* are mounted in spaced-apart relationship with one another with a pair of cross bars 24*a*, 24*b*, which are bolted to the base rails 22*a*, 22*b* with bolts 25. On their inner surfaces 23*a*, 23*b*, each base rail 22*a*, 22*b* includes three mounting apertures 26 (FIG. 6). Each base rail 22*a*, 22*b* also includes an upper bearing surface 27. Those skilled in this art will appreciate that other materials, such as wood or plastic, can be used to form the base 20.

Figure 2:
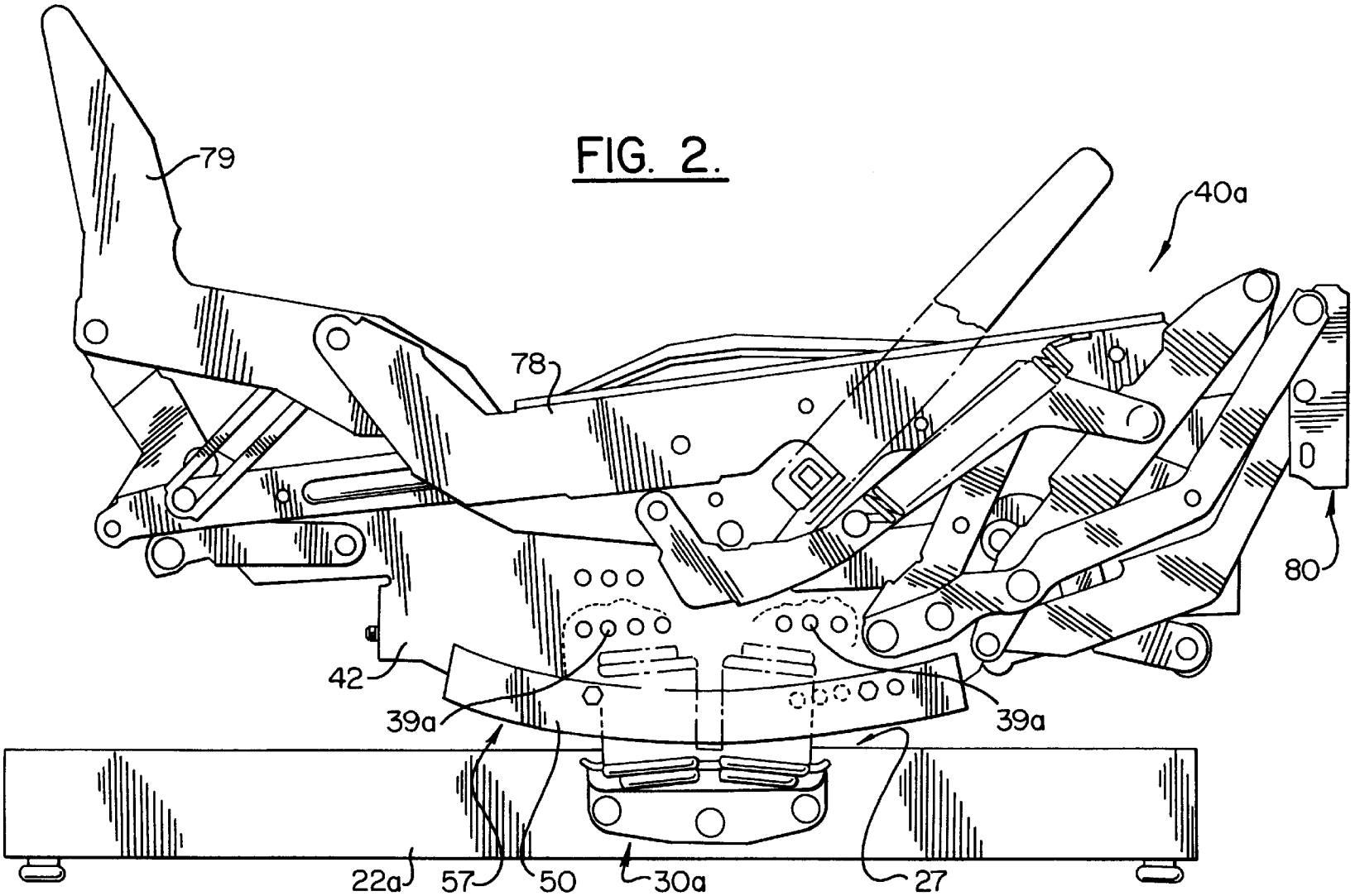
FIG. 2 is a lateral side view of a rocking and reclining mechanism of the chair of FIG. 1.

Referring now to FIGS. 2 and 4, the chair 10 includes a pair of reclining assemblies 40*a*, 40*b*, each of which is mounted above a respective base rail 22*a*, 22*b* through one of a pair of spring assemblies 30*a*, 30*b*. The spring assemblies 30*a*, 30*b* and reclining mechanisms 40*a*, 40*b* are mirror images of one another about a vertical plane that bisects the chair 10 equidistant from the armrests 16. As such, only the spring assembly 30*b* and reclining mechanism 40*a* will be described in detail herein; those skilled in the art will recognize that this discussion is equally applicable to their mirror image structures located on the opposite side of the chair 10.

The spring assembly 30*b* (FIGS. 4 and 5) includes a lower mounting bracket 32 having a downwardly-extending vertical flange 33, a pair of helical springs 36, and an upper mounting bracket 37 having an upwardly-extending vertical flange 38. The vertical flange 33 is mounted to the inner surface 23*a* of the base rail 22*a* through bolts 34*a*, which are inserted through mounting apertures 34 in the vertical flange 33 and into mounting apertures 26 of the base rail 22*a* (FIG. 6). The springs 36 are oriented so that their longitudinal axes are upright; they are fixed to and positioned above the horizontal portion 33*a* of the lower mounting bracket 32. The springs 36 are typically formed of 6 or 7 gauge spring steel. The horizontal portion 38*a* of the upper mounting bracket 37 is then fixed to the upper portions of the springs 36, and the vertical flange 38 is mounted to a mounting plate 42 of the reclining mechanism 40*b*. A front mounting opening 39*b* is located in the front portion of the vertical plate 38, and a rear mounting hole 39*c* is located in the rear portion of the vertical plate 38 (FIG. 6). These receive bolts 39*a*, which attach the vertical plate 38 to the mounting plate 42.

The illustrated reclining mechanism 40*a* (FIGS. 2 and 3) is a "three-way" reclining mechanism, which indicates that it controls the movement of the seat 12 and backrest 14 between an upright position, an intermediate "TV" position, in which a footrest 80 is extended in front of the seat 12, and the backrest 12 and the seat 12 remain in the same positions relative to one another, and a fully reclined position, in which the backrest 14 reclines (i.e., takes a shallower angle to the underlying surface) relative to the seat 12. The reclining mechanism 40*a* comprises a number of pivotally interconnected links that enable it to move the seat 12 and backrest 14 relative to the base 20 in the desired fashion. The reclining mechanism 40*a* includes a seat mounting link 78 that is mounted to the seat 12, and also includes a backpost 79 that is mounted to the backrest 16.

The illustrated reclining mechanism 40*a* is well known in this art and need not be described in detail herein. Those skilled in this art will recognize that other three-way reclining mechanisms can also be mounted to the base 20 via the rocker assembly 30*a*. Exemplary reclining mechanisms include those illustrated in U.S. Pat. Nos. 4,319,780 and 4,519,647 to Rogers. Also, some two-way mechanisms (i.e., those that cause a backrest rigidly fixed to the seat to move between upright, TV, and fully reclined positions) and some one-way mechanisms (those that cause a backrest rigidly fixed to the seat to move between upright and reclined positions) can also be employed in chairs of the present invention.

The reclining mechanism 40*a* (FIGS. 2 and 6) is mounted laterally from the spring assembly 30*a* via a cam mounting plate 42. One bolt 39*a* is inserted through the front mounting aperture 39*b* of the vertical plate 38 of the upper mounting bracket 37 and into one of a series of four front spring mounting holes 44. These front spring mounting holes 44 are distributed in a horizontal line across the cam mounting plate 42 and are located to enable the mounting position of the spring assembly 30*a* to be adjusted relative to the cam mounting plate 42 depending on the desired characteristics of the chair 10. Preferably, the holes 44 are spaced on ½ inch centers, but this spacing can vary as desired. Similarly, a series of four rear spring mounting holes 45 is aligned horizontally and similarly spaced on a rear portion of the cam mounting plate 42; one of the holes 45 receives another bolt 39*a* as it extends through the rear mounting aperture 39*c* to mount the upper mounting bracket 37 to the cam mounting plate 42. The cam mounting plate 42 also includes a series of front cam mounting holes 46 and a series of rear cam mounting holes 47 positioned adjacent the mounting plate lower edge 43.

An arcuate rocker cam 50 (FIGS. 2 and 6) is mounted to the lateral surface of the cam mounting plate 42. Illustratively and preferably, the rocker cam 50 is formed of a hollow steel tube of rectangular cross-section, which typically has a height of between about ½ and 2 inches and a width of between about ¼ and 2 inch. The rocker cam 50 includes a front aperture 52 and a rear aperture 54; these are aligned with respective front and rear mounting holes 44, 45 so that the rocker cam 50 can be mounted to the cam mounting plate 42 with bolts 55, 56. The rocker cam 50 is mounted to the cam mounting plate 42 so that its arcuate lower surface 57 is positioned below the lower edge 43 of the cam mounting plate 42 and rests upon the upper surface 27 of the base rail 22*a*. The lower surface 57 should have a radius of curvature of between about 10 and 25 inches for a suitable rocking motion.

The cam mounting plate 42 also includes inwardly-extending front and rear flanges 48, 49 (FIGS. 3 and 4). These are bolted to, respectively, front and rear cross members 60, 62, which extend between the flanges 48, 49 and corresponding flanges on the reclining mechanism 40*b*. The front and rear cross-members 60, 62 assist in the synchronization of movement between the reclining mechanisms 40*a*, 40*b* during reclining and prevent twisting of the reclining mechanisms 40*a*, 40*b*.

The movement of the chair 10 is controlled by an actuation assembly 70 (FIGS. 3 and 4), which includes a torque tube 72, an actuation linkage 74, and a handle 76. The torque tube 72 extends through the seat mounting bracket 78 that is attached to the reclining mechanism 40*a* and to the seat 12, and the handle 76 is positioned laterally of and below one of the armrests 16. The actuation linkage 74 is attached to the torque tube 72 and to the front cross member 60. In addition, a rocker foot 75 is attached to the actuation linkage 74.

Rotation of the handle 76 causes the reclining mechanisms 40*a*, 40*b* to move the chair 10 from the upright to the reclined position. As this occurs, the rocker foot 75 extends forwardly and downwardly to contact the upper surface of the front cross-member 24*a*, thereby preventing the chair 10 from rocking while in a reclined position.

The chair 10 of the present invention can be advantageously assembled through the following steps (see FIG. 6). First, the base 20 is constructed by inserting the bolts 25 into apertures in the cross members 24*a*, 24*b* and the base rails 22*a*, 22*b*. Separately, the rocker cams 50 can be attached to the cam mounting plate 42 with bolts 55, 56, which are inserted into respective ones of the cam mounting holes 46, 47 that position the rocker cams 50 relative to the cam mounting plate 42 to provide the desired rocking characteristics. The spring assemblies 30*a*, 30*b* are then attached to the cam mounting plate 42; as with the attachment of the rocker cams 50, the spring assemblies 30*a*, 30*b* are attached so that the bolts 34*a*, 39*a* are inserted into respective ones of the spring mounting holes 44, 45 that position the spring assemblies 30*a*, 30*b* relative to the cam mounting plate 42 for desired rocking characteristics. The cross members 60, 62 can then be bolted to the front and rear flanges 48, 49. The torque tube 72 can then be inserted into the seat mounting bracket 78 and the remainder of the actuation assembly 70 can be attached. Finally, this entire subassembly can be bolted to the base 20 to create a rocker-recliner assembly 82. The remaining portions of the chair 10 (i.e., the seat 12, the armrests 16, the backrest 18, and the footrest 80) can then be attached to complete production of the chair 10.

The configuration and assembly method of the rocker-recliner assembly 82 of the present invention has numerous advantages over prior art one-piece rocker units. For example, the assembled rocker-recliner assembly 82 can be shipped disassembled (base rails 22*a*, 22*b*, base cross members 24*a*, 24*b*, upper cross members 60, 62, spring assemblies 30*a*, 30*b*, and reclining mechanisms 40*a*, 40*b*) and assembled entirely at the manufacturing site of the chair 10. This is significantly more convenient than the assembly of prior art rocker units that include the springs, cross members and base as an integrated unit, as such units, due to their bulk, are extremely unwieldy and awkward to ship and store on site. Further, the present configuration allows the manufacturer to select an appropriate rocker cam on site rather than being forced to either use the rocker cam provided with the rocker unit or replace it in a cumbersome operation.

In addition, the inclusion of the series of cam mounting holes and the series of spring mounting holes in the cam mounting plate 42 enables the manufacturer to select mounting holes that best fit the reclining mechanisms and rocker cams to be employed with a particular chair model. As a result, the manufacturer can employ the same rocker-recliner unit 82 with any number of chair models by simply varying the mounting locations of the rocker cams 50 and spring assemblies 30*a*, 30*b*.

Further, the absence of cross-members 60, 62 during the attachment of the spring assemblies 30*a*, 30*b* facilitates assembly, as significantly more "working" volume is available to an assembler than is present for prior art rocker units.

Additionally, the spring assemblies 30*a*, 30*b* are mounted directly to the base plates 42 of the reclining mechanisms 40*a*, 40*b*. This configuration eliminates the need for an additional part (namely, the auxiliary mounting plate) found in prior art rocker units.

Moreover, the employment of molded hollow steel tubing for the rocker cams 50 rather than wood can significantly improve the precision with which the rocker cams 50 are produced. By simply molding, extruding, or otherwise forming a straight length of steel tubing into an arcuate shape, the necessary precision of shape (which, of course, directly impacts rocking comfort) can be achieved for a significantly lower cost than prior art wooden or plastic rocker cams. In addition, the hollow steel rocker cams of the present invention may be stronger, more durable, and more reliable than prior art rocker cams.

The foregoing embodiments are illustrative of the present invention, and are not to be construed as limiting thereof. The invention is defined by the following claims, with equivalents of the claims to be included therein.

That which is claimed is:

1. A rocking and reclining seating unit, comprising:

a base having a pair of generally horizontal planar bearing surfaces;

a generally horizontally-disposed seat positioned above said base;

a generally upright backrest positioned above said base rearward of said seat;

a pair of reclining mechanisms for moving said seat and backrest between upright and reclined positions relative to said base, each of said reclining mechanisms comprising a plurality of pivotally interconnected links, each of said pair of mechanisms including a seat mounting plate attached to said seat and a base plate, said base plate including first and second sets of spring assembly mounting holes and first and second sets of rocker cam mounting holes, and further including front and rear cross-member mounting locations;

front and rear stabilizing cross-members for synchronizing the movement of said pair of mechanisms between the upright and reclined positions, said front stabilizing cross-member being attached between said front cross-member mounting locations of said base plates, and said rear stabilizing cross-member being attached between said rear cross-member mounting locations of said base plates;

a pair of rocker cams, each of which is attached to a respective mechanism base plate via fasteners inserted through one of said first set of rocker cam mounting holes and one of said second set of rocker cam mounting holes, and each of which includes an arcuate lower contact surface positioned below a lower edge of said base plate to contact a respective one of said base bearing surfaces, said lower contact surfaces being configured for rolling contact with said base bearing surfaces such that said seat has a rocking motion; and a pair of rocker spring assemblies, each of which includes a resilient member that biases said seat against rocking motion relative to said base, each of said rocker spring assemblies being attached to a respective base plate and to said base via fasteners inserted into one of said first set of spring assembly mounting holes and one of said second set of spring assembly mounting holes.

2. The seating unit defined in claim 1, wherein each of said rocker spring assemblies is attached directly to a respective base plate.

3. The seating unit defined in claim 1, wherein said rocker cams comprise hollow tubes having a rectangular cross-section.

4. The seating unit defined in claim 3, wherein said rocker cams are formed of steel.

5. The seating unit defined in claim 1, wherein said resilient members comprise helical springs.

6. The seating unit defined in claim 1, wherein said rocker cams are attached directly to respective ones of said base plates.

7. The seating unit defined in claim 1, wherein said reclining assembly further comprises a stabilizing linkage that extends when said seating unit moves to a reclined position to prevent said seat from rocking relative to said base.

8. The seating unit defined in claim 1, wherein each of said reclining mechanisms is a three-way mechanism.

9. The seating unit defined in claim 1, wherein said front cross-member mounting locations of said base plates comprise inwardly extending flanges, and wherein said rear cross-member mounting locations of said base plates comprise inwardly extending flanges.

10. The seating unit defined in claim 1, wherein said first and second sets of rocker cam mounting holes are each longitudinally aligned.

11. The seating unit defined in claim 1, wherein said first and second sets of spring assembly mounting holes are each longitudinally aligned.

12. A rocking and reclining seating unit, comprising:

a base having a pair of generally horizontal planar bearing surfaces;

a generally horizontally-disposed seat positioned above said base;

a generally upright backrest positioned above said base rearward of said seat;

a pair of reclining mechanisms for moving said seat and backrest between upright and reclined positions relative to said base, each of said mechanisms comprising a plurality of pivotally interconnected links, each of said pair of mechanisms including a seat mounting plate attached to said seat and a base plate;

front and rear stabilizing cross-members for synchronizing the movement of said pair of mechanisms between the upright and reclined positions, said front and rear stabilizing cross-members being attached between said base plates;

a pair of hollow rocker cams of substantially rectangular cross-section, each of which is formed of steel and attached with a respective mechanism base plate, and each of which includes an arcuate lower contact surface positioned below a lower edge of said base plate to contact a respective one of said base bearing surfaces, said lower contact surfaces being configured for rolling contact with said base bearing surfaces such that said seat has a rocking motion; and a pair of rocker spring assemblies, each of which includes a resilient member that biases said seat against rocking motion relative to said base, each of said rocker spring assemblies being attached with a respective base plate and said base.

13. The seating unit defined in claim 12, wherein each of said rocker spring assemblies is attached directly to a respective base plate.

14. The seating unit defined in claim 12, wherein said resilient members comprise helical springs.

15. The seating unit defined in claim 12, wherein said rocker cams are attached directly to respective ones of said base plates.

16. The seating unit defined in claim 12, wherein said reclining assembly further comprises a stabilizing linkage that extends when said seating unit moves to a reclined position to prevent said seat from rocking relative to said base.

17. The seating unit defined in claim 12, wherein each of said reclining mechanisms is a three-way mechanism.

18. The seating unit defined in claim 12, wherein said base plates comprise two sets of inwardly extending flanges, and wherein said front and rear cross-members extend between respective sets of said flanges.

* * * * *